US007802338B1

(12) United States Patent
Hall

(10) Patent No.: US 7,802,338 B1
(45) Date of Patent: Sep. 28, 2010

(54) RAIN-GUTTER CLEANING SYSTEM

(76) Inventor: Ira George Hall, 17500 Skyline Blvd., Los Gatos, CA (US) 95030

( * ) Notice: Subject to any disclaimer, the term of this patent is extended or adjusted under 35 U.S.C. 154(b) by 0 days.

(21) Appl. No.: 12/456,027

(22) Filed: Jun. 10, 2009

(51) Int. Cl.
*A47L 5/00* (2006.01)

(52) U.S. Cl. ..... 15/23; 15/92; 15/339; 15/348; 15/383; 15/384; 15/391

(58) Field of Classification Search ..... 15/23, 15/92, 339, 348, 383, 384, 391; *A47L 5/00*
See application file for complete search history.

(56) References Cited

U.S. PATENT DOCUMENTS 6,185,782 B1 2/2001 Hall

2008/0216869 A1* 9/2008 Dayton et al. ..... 134/6

* cited by examiner

*Primary Examiner*—David A Redding
(74) *Attorney, Agent, or Firm*—Robert Charles Hill

(57) ABSTRACT

A rain-gutter cleaning system has an agitator head that is mounted to the top end of a long suction tube and pole and supported aloft by them. A vacuum pump on the ground is connected to bring rain-gutter debris down the suction tube and into a collection bag. The agitator head includes opposite, synchronized rotating paddles that tear and break up tangles and clogs encountered in a rain gutter and that helps direct the loosened debris down the throat of the suction tube. An optional camera mounted atop the agitator head allows an operator on the ground below to see the performance inside of the rain gutter on a small monitor screen.

9 Claims, 5 Drawing Sheets

RAIN-GUTTER CLEANING SYSTEM

BACKGROUND OF THE INVENTION

1. Field of the Invention

The present invention relates to rain-gutter cleaners, and more particularly to pole mounted devices that allow an operator to remain on the ground even when cleaning a rain gutter high overhead.

2. Description of Related Art

A roof can shed large amounts of rainwater during a storm, and the collected volume of water at the height of a typical roof can do a lot of damage if it's allowed to crash to the ground uncontrolled. So rain gutters have been used for centuries to catch the water at the eaves and channel it to a downspout.

Unfortunately, these gutters also catch leaves and other debris that can clog the gutter and prevent the downspouts from functioning. The present inventor, Ira George Hall, answered this problem with U.S. Pat. No. 6,185,782 (Hall '782), issued Feb. 13, 2001.

The most direct way to clean out rain gutters is to go up on the roof and use a small scoop or hands to clean out the build-up. But working so close to the edge of a roof can be very dangerous. Working from ladders is a little better, but ladders are not completely safe either. Ladders are also awkward to move about and position, and some spots along the rain gutter cannot be reached by ladder.

The rain-gutter cleaning system described in Hall '782 uses an agitator head mounted on the distal end of a long pole. A vacuum pump on the ground is connected to the agitator head with a long suction tube. A set of paddles mounted to a rotating drum slap against any debris in the bottom of a rain gutter. The vacuum and the paddles lift the debris up into an auger screw that forces the material into the suction tube and then down to the ground where it can be disposed of.

Experience is now showing that such an auger screw requires too large an enclosure volume, and the screw itself can get clogged with wet debris. The usual debris in rain gutters can include twigs and small branches, and compacted materials that are hard to break up and remove. Each ounce of weight that can be saved in the construction of the agitator head can lead to better mobility and reduced operator fatigue. And a more compact housing would make it easier to maneuver through tree branches overhanging the eaves. So what is needed is a rain gutter vacuuming system that weighs less and does a better job of breaking up even compacted debris.

SUMMARY OF THE INVENTION

Briefly, a rain-gutter vacuuming system embodiment of the present invention has an agitator head that is mounted to the top end of a long suction tube and pole and supported aloft by them. A vacuum pump on the ground is connected to bring rain-gutter debris down the suction tube and into a collection bag. The agitator head includes opposite rotating paddles that gather together and break up leaves, twigs, and small branches collected in a rain gutter. The loosened debris is pulled by the vacuum down the throat of the suction tube. A camera may be mounted on the agitator head to allow an operator on the ground below to see the inside of the rain gutter on a small monitor screen. The camera can also record the cleaning process and document damaged or rotted gutters when connected to a camcorder.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
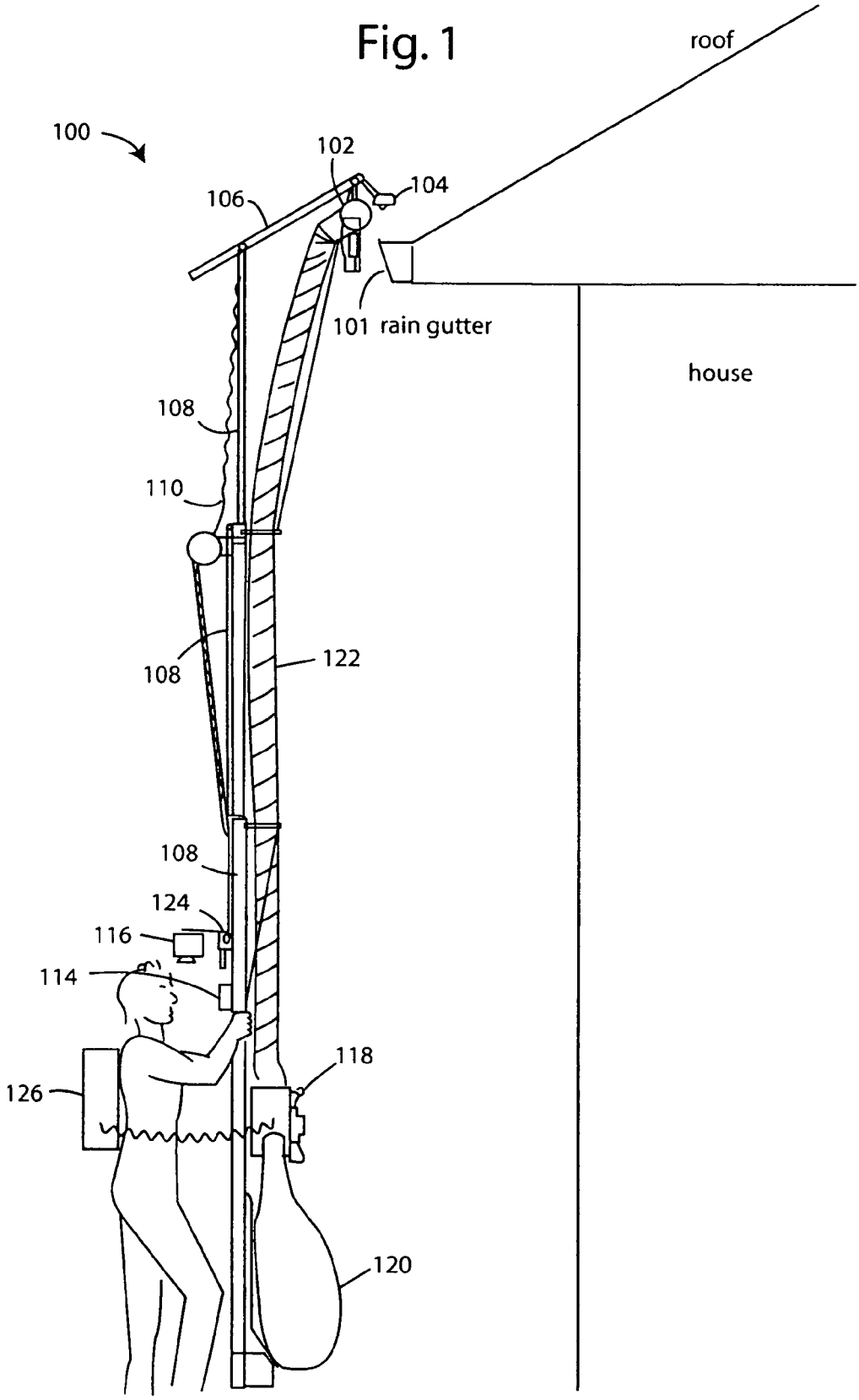
FIG. 1 is a diagram of a rain-gutter cleaning system embodiment of the present invention being used on a two-story house by an operator.

FIG. 1 illustrates a rain-gutter cleaning system embodiment of the present invention referred to herein by the reference numeral 100. A rain gutter 101 that needs cleaning may be high on the eaves of a one or two story house. An agitator head 102 and video camera 104 are held aloft on a control boom 106. A telescoping extension pole 108 is fitted with a control cable 110. Means are provided to automatically take up any slack in the control cable 110. A control panel 114 allows the operator to control activity within the agitator head 102. A display monitor screen 116 is connected to the video camera 104 and allows the operator to look into the rain gutter 101.

In alternative embodiments of the present invention, the display monitor screen 116 includes a video tape recorder, e.g., am 8 mm type, that allows the before and after condition of the rain gutter to be recorded. Such recording can be used to increase customer good will, or used in legal proceedings to prove or disprove liability.

A vacuum cleaner 118 has a collection bag 120 for loosened debris that flows down from the agitator head 102 through a suction hose 122. In alternative embodiments of the present invention, the extension pole 108 and suction hose 122 can be partly or totally replaced by lightweight rigid pipe sections. The vacuum cleaner 118 and collection bag 120 could also be mounted on a truck, or they could be replaced by a shop vacuum, instead of being carried by the operator.

An adjustment knob 124 or switch is used to adjust the height of the telescoping extension pole 108 through a system of concave rubber rollers. The necessary operating power for the agitator head 102, video camera 104, display monitor screen 116, and vacuum cleaner 118, can be provided by a small gasoline-powered engine, battery, or electrical extension cord. Such power alternatives are represented by a backpack power unit 126. Each different kind of power source has its own advantages and disadvantages. In alternative embodiments of the present invention vacuum 118, collection bag 120 and power unit 126 can be replaced by using flexible ducting that connects to a remote vacuum that may be portable or truck mounted.

Embodiments of the present invention are portable and enable operators to clean rain gutters while standing on the ground. A gas engine or other power unit maybe mounted in a back pack, much like a conventional leaf blower. The engine powers a vacuum system, attached to which is an expandable suction tube capable of reaching the rain gutters on a one and two story house while the operator is standing on the ground.

Figure 2A:
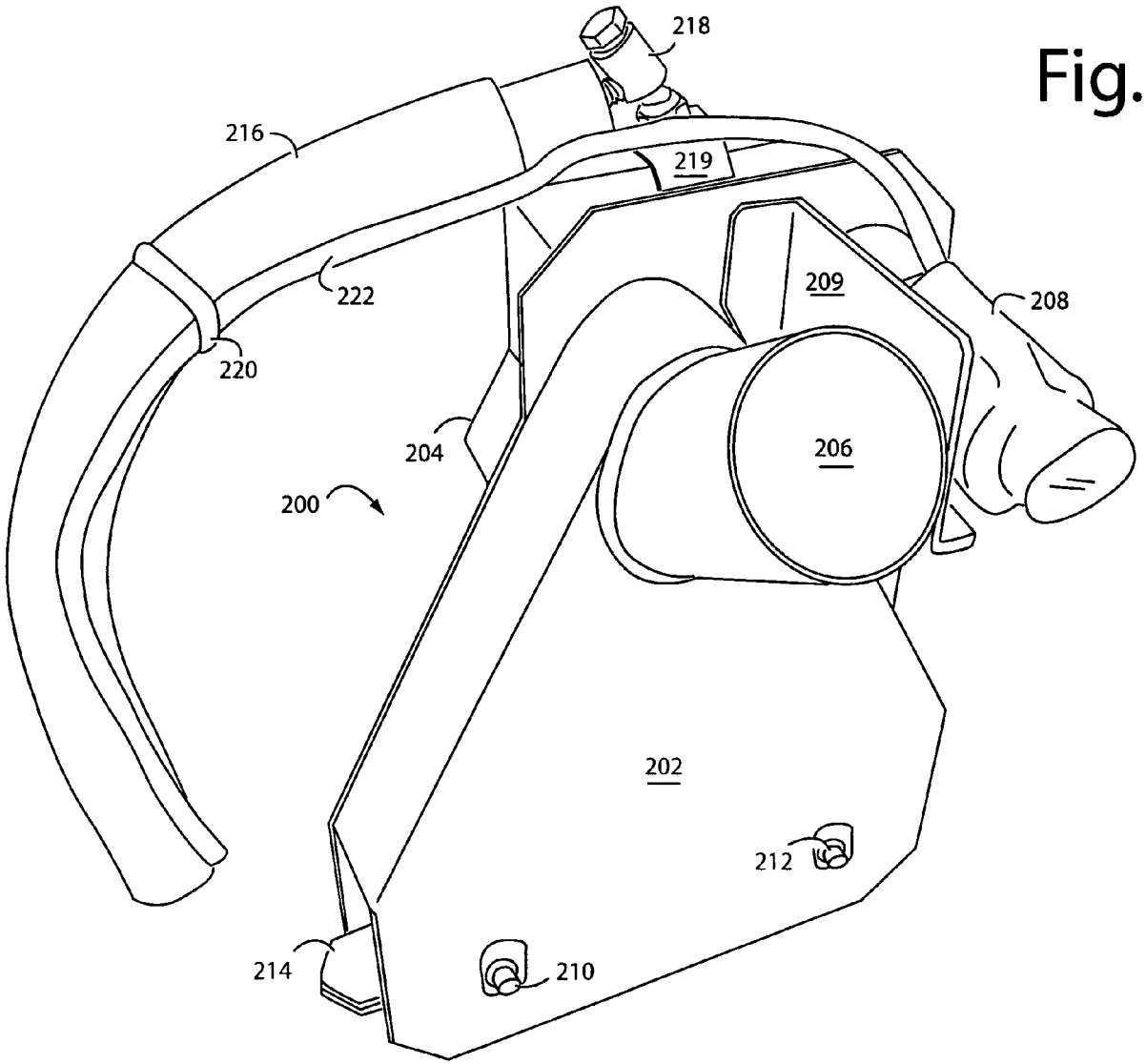
FIG. 2A is a front perspective view diagram of an agitator head for a rain-gutter cleaning system like that shown in FIG. 1.
Figure 2B:
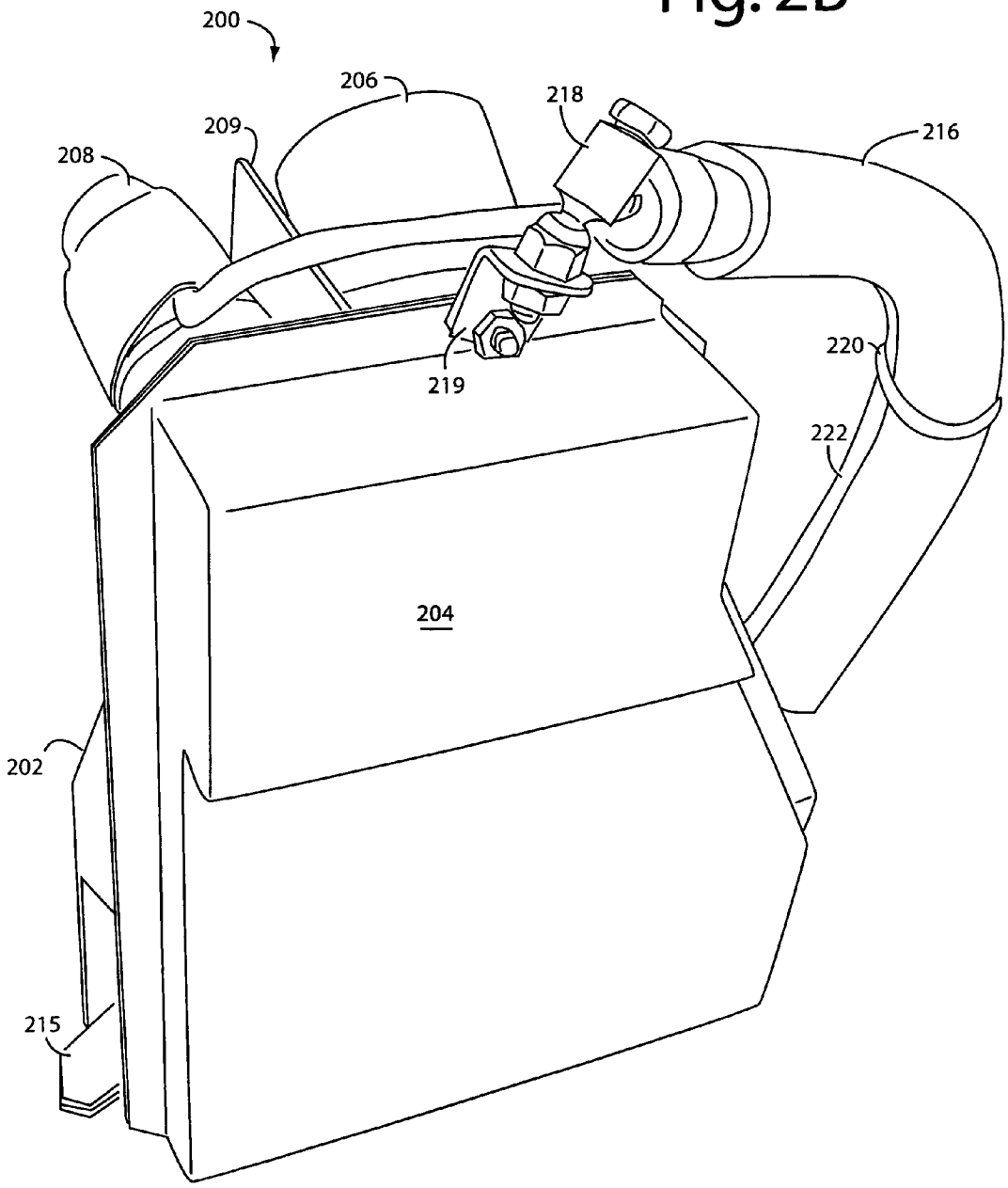
FIG. 2B is a rear perspective view diagram of the agitator head of FIG. 2A.
Figure 2C:
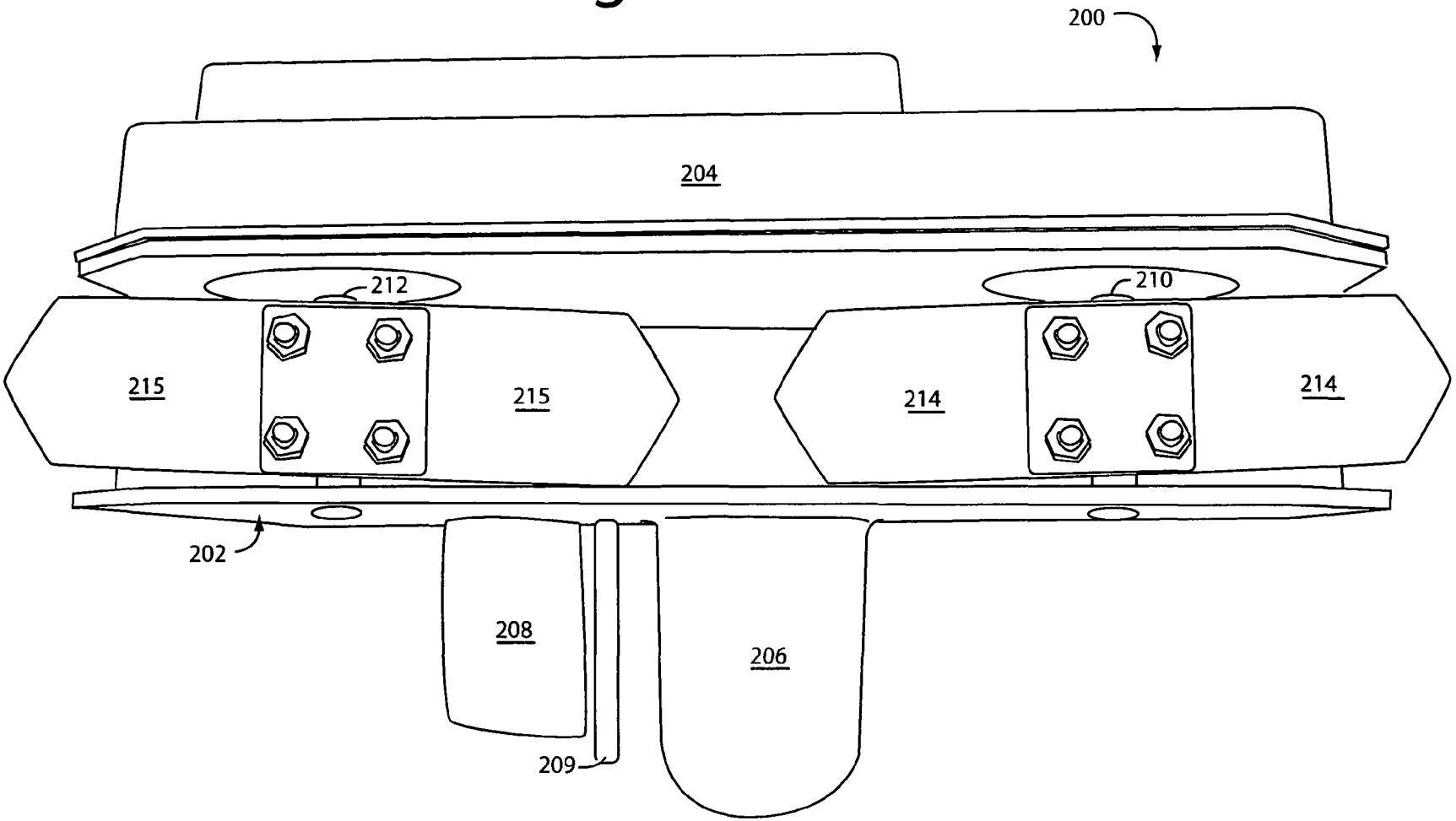
FIG. 2C is a bottom perspective view diagram of the agitator head of FIG. 2A, and shows the opening in the bottom through which the paddles protrude and rotate.

FIGS. 2A-2C represent an agitator head 200 that could be used in system 100. The whole is sized to fit and slip longitudinally within a typical rain gutter at a roof edge. Agitator head 200 comprises a vacuum and paddles chamber 202, a paddle transmission 204, and a vacuum connection 206 for a hose. A motor 208 mounted to a bracket 209 powers the transmission 204 to turn two rotating hub assemblies 210 and 212 and double-ended and synchronized paddles 214 and 215. A paddle tip is just visible in the perspective views of FIGS. 2A and 2B protruding from the open bottom of the paddle and vacuum chamber 202. FIG. 2C shows paddles 214 and 215 more fully.

Figure 3:
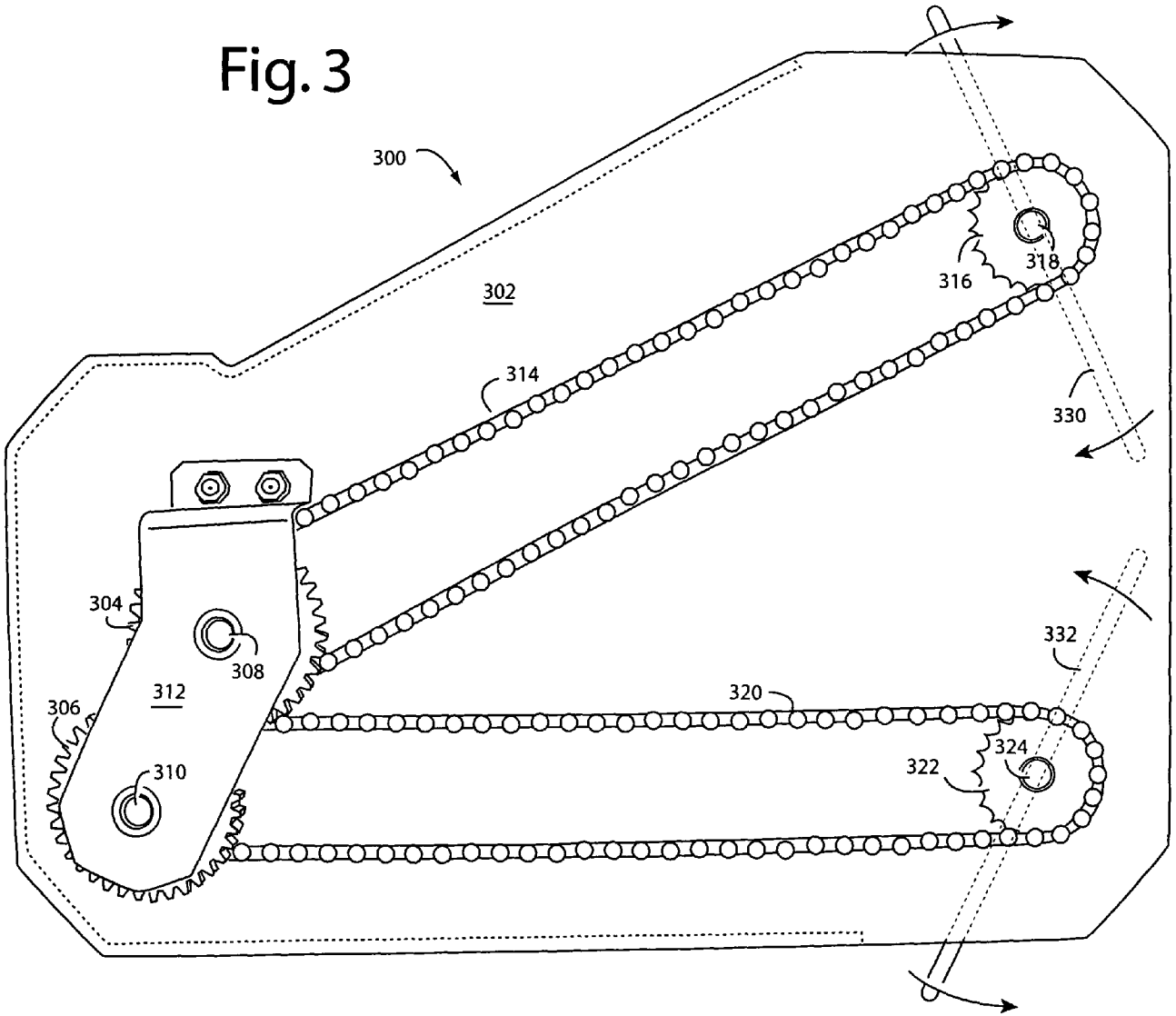
FIG. 3 is a plan view diagram of a paddle transmission assembly used in the agitator head of FIGS. 2A-2C.

Gears and chain drives inside the transmission 204 are connected to the two rotating hub assemblies 210 and 212 and rotate one rotating hub assembly and paddle clockwise while the other rotates counter-clockwise. FIG. 3 shows one such arrangement in greater detail. The paddles 214 and 215 are typically aligned on their rotating hub assemblies 210 and 212 so that their two tips will point at each other every 180° of rotation. FIG. 2C shows this configuration, and such helps to beat debris between the paddles to break it up. The rotating paddles also act to partially block and then open the vacuum that reaches the bottom of the gutter being cleaned. Such pulsating vacuum also aids in dislodging debris.

As shown in FIG. 2B, a crane 216 is fitted at its distal end with a loose gimbal 218 such that the agitator head 200 can dangle below. A bracket 219 is used to attach the lower end of the gimbal 218 to agitator head 200, preferably at a point that allows the agitator head 200 to hang with its bottom edge level both laterally and longitudinally. Such gimbal 218 is relatively loose given the weigh it supports, and its configuration allows a limited range of pivoting, twisting, and swiveling of the agitator head on the crane 216. A wire tie 220 is used to dress a power wire cable 222 for motor 208. The crane 216 can be attached to the end of a long telescoping pole, as shown in FIG. 1. Alternatively, power wire cable 222 could be run down inside crane 216 and the telescoping pole.

FIG. 3 represents a paddle transmission assembly 300 that could be used for the agitator head of FIGS. 2A-2C. The paddle transmission assembly 300 comprises a base plate 302 with a motor and paddles mounted on the backside. A driven gear 304 meshes with a drive gear 306 and has a 1:1 ratio. Driven gear 304 is sistered to a chain sprocket (not visible) on a free axle 308. Similarly, drive gear 306 is also sistered to another chain sprocket (not visible) on a motor drive shaft 310.

A small DC electric motor, like motor 208 in FIGS. 2A-2C, is mounted to the backside of the transmission 300, and it receives operating power on a connecting wire run down a pole to the ground and an operator. Such motor could be powered in forward and reverse directions by switching the electrical polarity. Faster and slower speeds could be realized by changing the applied voltage and/or gear ratios.

The two chain sprockets turn in opposite directions due to the gear meshing. A first chain 314 drives a sprocket 316 clockwise, e.g., on a spindle hub 318. A second chain 320 drives a sprocket 322 counter-clockwise, e.g., on a spindle hub 324. These rotate paddles 330 and 332 in opposite directions, but synchronized such that their respective tips will come close together twice each rotation.

The rotating paddles slap and beat debris within their reach to loosen it for vacuuming and removable. In general, the rotating paddles slap and beat debris up in the space between them. But in some situations it may be advantageous to reverse their mutual rotations.

The gearing and motor speeds to use should be empirically selected to produce the best cleaning action of debris from a rain-gutter. A variable control may also be advantageous when conditions and debris materials vary in the field. The hardness and stiffness of the paddles 330 and 332 can also be adjusted for best operation. In a prototype that was built that produced good results, the paddles were cut from two thicknesses of rubber very similar to that used in heavy duty automotive tire inner tubes. Of course other materials and configurations may produce better results in particular situations.

A method embodiment of the present invention for cleaning rain gutters includes dragging an agitator head along inside a rain gutter to collect debris with a vacuum. A pair of oppositely rotating paddles are mounted in a bottom edge of said agitator head. The debris is beat and slapped with the pair of oppositely rotating paddles, and they are synchronized to come close together at their tips twice each rotation. The agitator head can be lofted above ground to a roof edge with a telescoping pole. The performance of the agitator head above ground can be monitored with a video camera. It can also be advantageous to reverse the rotation of the pair of oppositely rotating paddles.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A rain-gutter cleaning system, comprising:

an agitator head sized to fit a rain gutter and having a connection for dangling beneath the distal end of a pole;

a paddle and vacuum chamber having a vacuum hose connection at a top end and an open bottom edge for sucking up debris;

a pair of opposite, double-ended paddles with hubs positioned to rotate in opposition to one another in the open bottom edge of the paddle and vacuum chamber;

a transmission for synchronously driving the double-ended paddles and hubs such that the tips of the paddles come close together twice each rotation; and a motor connected to drive the transmission when it receives power.

2. The rain-gutter cleaning system of claim 1, further comprising:

a power source located at ground-level that is connectable to power the motor in forward and reverse directions.

3. The rain-gutter cleaning system of claim 1, wherein:

the pair of opposite, double-ended paddles are arranged to produce a vacuum pulsing at the bottom open edge of the paddle and vacuum chamber as they open and close twice each rotation;

wherein, said pulsing vacuum improves the lifting and removable of said debris.

4. The rain-gutter cleaning system of claim 1, further comprising:

an arrangement of gears disposed within the transmission to convert the single input drive of the motor to opposite rotations of the pair of opposite, double-ended paddles with hubs, and that maintains their mutual synchronism.

5. The rain-gutter cleaning system of claim 1, further comprising:

a telescoping pole on top of which is mounted the agitator head and providing for a user to remain on the ground while guiding the agitator head along an inside channel of a clogged rain gutter at the edges of a roof of a building.

6. The rain-gutter cleaning system of claim 5, further comprising:

a loose gimbal to allow dangling of the agitator head on the telescoping pole when positioned between the agitator head and the telescoping pole.

7. The rain-gutter cleaning system of claim 6, further comprising:

a connection for the loose gimbal at a point that allows the agitator head to hang with its bottom edge level both laterally and longitudinally.

8. The rain-gutter cleaning system of claim 5, further comprising:

a camera system mounted to the pole such that a user on the ground may see into a rain gutter being cleaned.

9. The rain-gutter cleaning system of claim 1, further comprising:

a pole on top of which is mounted the agitator head and allowing a user to remain on the ground while guiding the agitator head along an inside channel of a clogged rain gutter at the edges of a roof of a building; and a video system mounted to the pole and such that a video recording may be made of said inside channel before, during, or after cleaning.

* * * * *